United States Patent [19]

Cormier

[11] 4,252,431

[45] Feb. 24, 1981

[54] ADJUSTABLE CORONA SUPPORT

[75] Inventor: Raymond G. Cormier, Nashua, N.H.

[73] Assignee: Nashua Corporation, Nashua, N.H.

[21] Appl. No.: 80,421

[22] Filed: Oct. 1, 1979

[51] Int. Cl.[3] ..... G03G 15/00

[52] U.S. Cl. ..... 355/3 CH; 250/325; 361/230

[58] Field of Search ..... 355/3 CH; 361/225, 230; 250/324–326

[56] References Cited

U.S. PATENT DOCUMENTS

| | | | |
|---|---|---|---|
| 3,800,153 | 3/1974 | Matsumoto et al. | 250/325 |
| 3,809,974 | 5/1974 | Gange et al. | 250/326 X |
| 3,919,605 | 11/1975 | Honda | 361/230 |
| 4,089,600 | 5/1978 | Ito et al. | 355/3 CH |

*Primary Examiner*—R. L. Moses

*Attorney, Agent, or Firm*—Kenway & Jenney

[57] ABSTRACT

Disclosed is an accurately adjustable mount for supporting a corona assembly of a photocopying machine. The accurate adjustment of the separation between the corona wires and the photosensitive surface of the photocopying machine is accomplished by separate cam mechanisms located at either end of the corona assembly. Locking means are provided for securing the corona assembly after the proper separation has been established by the cam mechanisms.

4 Claims, 5 Drawing Figures

ADJUSTABLE CORONA SUPPORT

BACKGROUND OF THE INVENTION

This invention relates to photocopying machines; and, more particularly, to the adjustable support for the corona assemblies which induce charge onto and neutralize charge on the photosensitive member used in such machines.

Typical photocopying machines have a revolving photosensitive drum which can accept and hold an electric charge. In operation, the drum surface is initially uniformly charged and thereafter selectively discharged according to the image to be copied. This selective discharge therefore leaves on the photosensitive drum an array of electric charges which form a latent image of the material to be copied. This latent image of electric charges is then exposed to oppositely charged toner particles which adhere to the photosensitive drum, thereby developing the image. This developed image is subsequently transferred to the surface of a copy sheet. After a copy has been made, the photosensitive drum is uniformly discharged in preparation for the next copy.

The electric charges are induced onto the photosensitive revolving drum by means of a corona assembly. A corona assembly usually includes at least one long, thin wire shielded on three sides by a metal channel. The corona assembly is maintained near the surface of the photosensitive drum. A sufficiently high voltage is applied to the wire to ionize the surrounding air and to induce electric charges onto the surface of the photosensitive drum. The amount of charge so induced is very sensitive to the distance of the corona wire from the surface of the photosensitive drum. Because of the manufacturing tolerances inherent in the mass production of photocopying machines, the distance between the corona wire and the surface of the photosensitive drum generally is adjustable after manufacture so that the proper voltage will be induced onto the surface of the photosensitive drum.

In the past according to one commercial practice, the corona wire has been mounted so that its position within the metal channel is adjustable, thereby allowing the distance between the wire and the photosensitive drum to be varied to a desired value. This method of mounting the corona wire so that its distance from the photosensitive drum surface can be adjusted makes adjustment difficult because it requires that the corona assembly be removed and adjustment cannot be made while the machine is running.

Accordingly, it is an object of the present invention to provide an adjustable support for the corona assembly which allows the simple, sure and efficient setting of the proper distance between the corona assembly wire and the surface of the photosensitive drum during machine operation if desired.

It is a further object of this invention to provide an adjustable support which securely locks the corona assembly in the proper location after the separation between the corona wires and the photosensitive surface has been adjusted.

SUMMARY OF THE INVENTION

According to the present invention, the apparatus for supporting a corona assembly having at least one corona wire for adjustment of the separation between the corona assembly and a moving photosensitive surface features a support assembly for slidingly supporting the corona assembly for movement substantially parallel to the photosensitive surface and a camming member engaging the support assembly for moving the support assembly toward and away from the photosensitive surface. In a preferred embodiment of the invention disclosed herein the moving photosensitive surface is a cylindrical rotating drum. In this embodiment, at least one rail adapted for slidingly engaging the corona assembly for movement substantially parallel to the photosensitive surface and for holding the corona assembly relative to the photosensitive surface is supported between two slidingly mounted, spaced apart end plates. These end plates are preferably oriented perpendicularly to the drum axial direction. Each end plate has an elongate slot adapted to engage closely the camming members whereby the end plates can be separately moved toward and away from the photosensitive surface in response to rotation of a respective camming member. In this embodiment, each end plate has a first and a second hole, and a first and a second locking screw are provided which pass through the respective first and second holes. The locking screws are adapted for slidingly engaging, respectively, two fixed tracks in the photocopying machine. These same screws secure the end plates to the machine in a locked position. Each end plate also has a guide member which slidingly engages a positionally fixed guide track in the machine. In this way, each of the end plates is constrained to move along a straight line substantially toward and away from the photosensitive surface of the rotating drum. The camming member preferably features an eccentrically mounted, rotatable circular disc, thereby creating the camming effect.

BRIEF DESCRIPTION OF THE DRAWINGS

The invention disclosed herein will be better understood with reference to the following drawings of which.

DESCRIPTION OF THE PREFERRED EMBODIMENT

Figure 1:
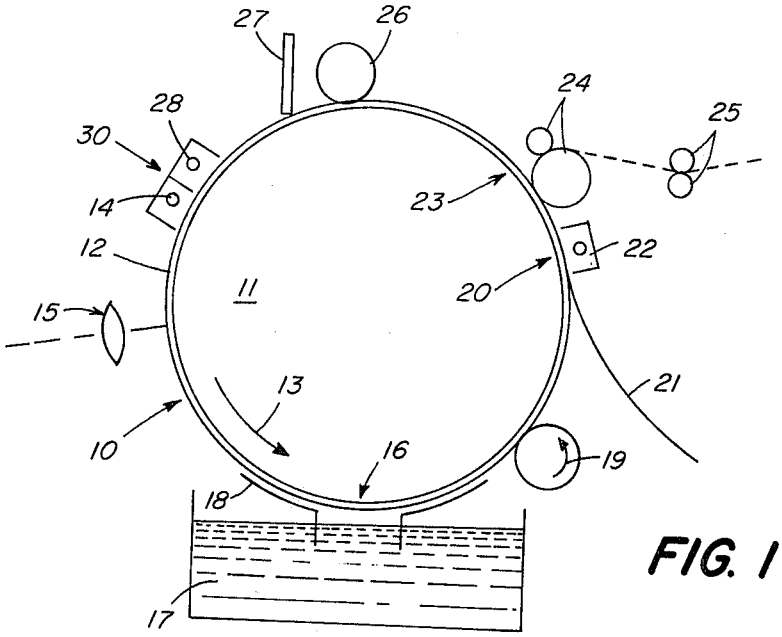
FIG. 1 is a schematic elevation view of a typical photocopying machine.

Referring first to FIG. 1, a typical photocopying machine 10 in which the present invention can be employed has a rotating drum 11 with a photosensitive surface 12 thereon rotating in the direction indicated by an arrow 13. A charge corona 14 located in close proximity to the drum 11 charges the photosensitive surface 12 to about +1000 volts. An optical system indicated generally at 15 focuses an image onto the drum 11 and the light selectively discharges the surface 12 so as to form a latent image comprising a pattern of electrical charges on the surface 12. The rotating drum 11 transports the latent image to a development station 16 where a liquid developer 17 having a negatively charged toner will contact the latent image to develop it. A development electrode 18 having a positive electrostatic charge of appropriate magnitude is located close to the surface 12 and serves to counteract any residual background voltage remaining on the drum surface. A counter-rotating metering roll 19 removes excess liquid. The surface 12, bearing the now-developed image, proceeds to a transfer station 20 where the image will be transferred to a copy material 21. A transfer corona 22, also in close proximity to the drum surface 12, applies a positive charge to the backside of the copy material 21 and causes the toner particles to be attracted to the surface of the copy material 21. During this process, the copy material 21 makes actual contact with the surface 12 and then must be removed from the surface at 23 and be led away from the drum 11 along a path defined by rollers 24 and 25. After transfer, there generally remains on the drum a residue of liquid developer. The surface 12 is cleaned continuously of this residue by a cleaning roller 26 and a cleaning blade 27. Finally, the surface is electrically neutralized prior to the next copying cycle by a high alternating voltage, for example 4800 volts, applied to a discharge corona 28. Both the charge corona 14 and the discharge corona 28 are mounted within a corona assembly 30.

Figure 2:
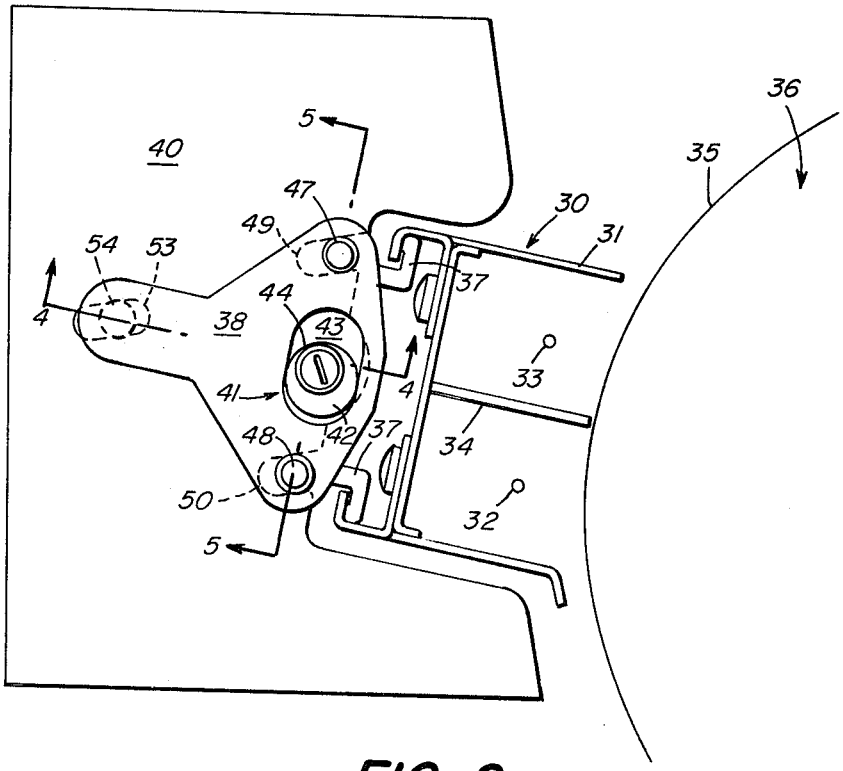
FIG. 2 is a front side elevation view of the support assembly according to the invention.

Referring now to FIG. 2, the corona assembly 30 includes a metal channel 31 surrounding thin corona wires 32 and 33. The wire 32 is the charging wire and the wire 33 is the discharging wire. These wires are, for example, 60 micron diameter unpolished tungsten. The wires 32 and 33 are supported within the corona assembly 30 under tension by conventional means (not shown) and are separated by a metal member 34. In a typical situation, a high voltage, for example 6300 volts (positive direct current), is applied to the charging wire 32. This high voltage ionizes the surrounding air and induces a positive potential, for example 1000 volts, onto a photosensitive surface 35 of a rotating drum 36. A typical photosensitive material is selenium.

The distance between the photosensitive surface 35 and the charging corona wire 32 must be carefully controlled because the voltage induced onto the surface 35 is very sensitive to corona wire-drum surface separation. For example, the induced voltage can increase by 30 to 40 volts for a 0.1 millimeter decrease in the wire-surface separation. In addition, destructive arcing can occur if the charging wire 32 is too close to the surface 35.

Thus, because of the inevitable dimensional variations and differences in drum characteristics with mass produced parts in higher speed machines, the distance between wire and drum surface must be accurately adjustable both at the time the photocopying machine is assembled and thereafter. The present invention allows for such accurate adjustment.

Figure 3:
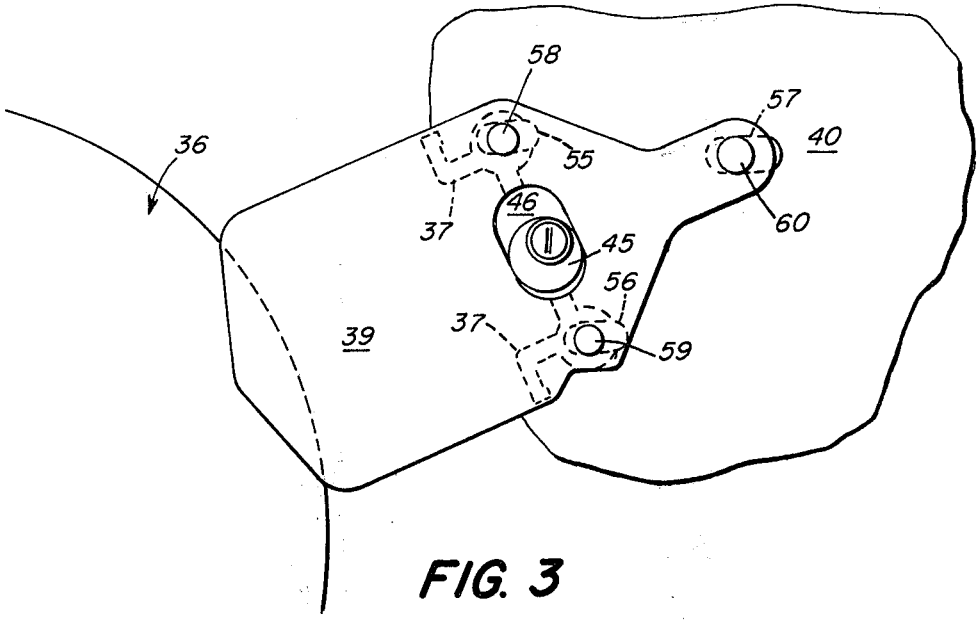
FIG. 3 is a rear side elevation view of the support assembly according to the invention.

Referring to FIGS. 2, 3, 4 and 5, the corona assembly 30 is slidingly mounted on a pair of rails 37. These rails 37 are supported between a front end plate 38 and, as shown in FIG. 3, a rear end plate 39. These two end plates are substantially identical in function; the rear end plate 39 is larger, however, providing a positive stop for the corona assembly 30 as it is inserted into the machine. The end plates 38 and 39 are in turn adjustably mounted on underlying machine frame members 40. The location of the front end plate 38 is adjusted by means of a cam 41 consisting of a circular disc 42 eccentrically mounted on the frame member 40. The disc 42 closely engages an elongate slot 43 in the front end plate 38 so that as the disc 42 is rotated (as by a tool inserted in a groove 44) the front end plate 38, and hence the corona assembly 30, is moved substantially toward and away from the photosensitive surface 35. Similarly, the location of the rear end plate 39 of FIG. 3 is independently adjustable by means of a cam 45 engaging an elongate slot 46 so that the separation between corona wires and drum surface can be adjusted.

Figure 5:
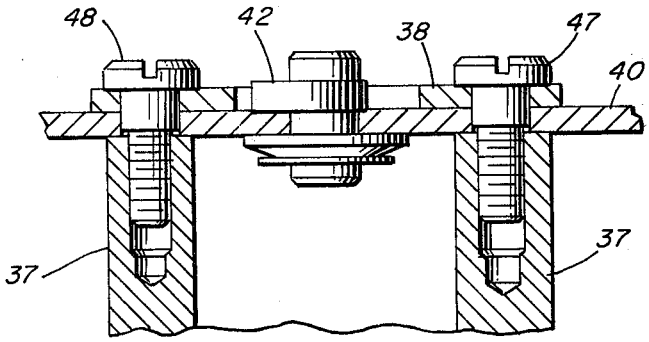
FIG. 5 is a cross-sectional view along section lines 5—5 of FIG. 1.

The front end plate 38 is constrained to move in a straight line in the following way: two holes through the front end plate 38 receive a pair of lockable screws 47 and 48 which extend through tracks 49 and 50 respectively in the frame member 40. These screws 47 and 48 screw into threaded portions of the pair of rails 37 as shown in FIG. 5. A third track 53 accepts a guide member, here a circular knob 54, protruding from the inside surface of the front end plate 38. The three tracks thereby constrain the front end plate 38 to straight line motion substantially toward and away from the photosensitive surface 35. The rear end plate 39 of FIG. 3 is similarly constrained to straight line motion by tracks 55, 56 and 57, screws 58 and 59, and guide member 60.

Figure 4:
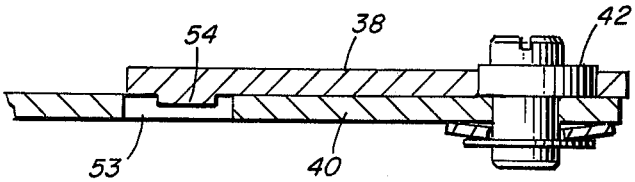
FIG. 4 is a cross-sectional view along section lines 4—4 of FIG. 1.

FIGS. 4 and 5 illustrate the invention in greater detail. FIG. 4, a view along section lines 4—4 of FIG. 2, shows the front end plate 38 with the circular knob 54 slidingly engaging the track 53. FIG. 5, a view along section lines 5—5 of FIG. 2, shows the lockable screws 47 and 48 screwed into threaded portions of the rails 37. Thus, to adjust the distance between the corona wire 32 of FIG. 1 and the photosensitive surface 35 at the front end plate, the lockable screws 47 and 48 are loosened and then the disc 42 is rotated until the proper separation is attained, followed by a retightening of the lockable screws 47 and 48.

It is thus seen that the objects of this invention have been achieved in that there has been disclosed a novel means for accurately adjusting the critical separation between the charge producing corona wire and the surface of the photosensitive drum even while the machine is operating, if desired. In addition, the corona assembly support securely locks the corona assembly in place after the desired separation between the corona wires and the photosensitive surface has been set.

SUMMARY OF MAJOR ADVANTAGES AND NON-OBVIOUSNESS OF THE INVENTION

The apparatus disclosed herein for adjusting the separation between the corona wires and the surface of the photosensitive drum allows for the simple and precise setting to the desired separation. This is so because the corona assembly is supported by end plates which are separately adjustable by means of two camming mechanisms. These camming mechanisms are easily rotated as by an ordinary screwdriver to effect the desired adjustment. Once the proper separation is achieved, the end plates are easily and securely fixed to the machine frame by means of locking screws. Importantly, the separation between corona assembly and drum surface can be adjusted without removing the corona assembly from the machine. The adjustment can even be made during machine operation.

Other efforts in the corona mounting art neither anticipate nor suggest the unique adjustable mounting means disclosed herein; nor do they enjoy the advantages found in the present invention. By way of example, Ito et al., U.S. Pat. No. 4,089,600 discloses adjustment screws which change the location of the charging wires in relation to the fixed corona assembly in which they are mounted. This is unlike the present invention in which the whole corona assembly is movable by a precision cam means allowing precise separation adjustment to be made simply and efficiently without removing the corona assembly from the machine.

Additions, subtractions, deletions and other modifications of the corona support disclosed herein will occur to those skilled in the art and are within the scope of the apended claims.

What is claimed is:

1. In a photocopying machine comprising:
(1) a moving photosensitive surface; and
(2) a corona assembly having at least one corona wire spaced apart from said photosensitive surface;
apparatus for supporting said corona assembly for adjustment of the separation between said corona assembly and said photosensitive surface comprising:
(a) support means for slidingly supporting said corona assembly for movement substantially parallel to said photosensitive surface; and
(b) camming means engaging said support means for moving said support means toward and away from said photosensitive surface, said camming means including means accessible from ends of the corona assembly for permitting said adjustment while said corona is operatively supported.

2. The apparatus of claim 1 wherein said support means comprises:
at least one rail adapted for slidingly engaging said corona assembly for said movement substantially parallel to said surface and for holding said corona assembly relative to said surface; and
two slidingly mounted, spaced apart end plates for supporting said at least one rail therebetween, each said end plate having an elongate slot adapted to engage closely said camming means, said camming means including rotatable cam members eccentrically mounted to positionally fixed portions of said machine, whereby said end plates can be separately moved toward and away from said photosensitive surface in response to rotation of said camming means.

3. In a photocopying machine comprising:
a moving photosensitive surface; and
a corona assembly having at least one corona wire spaced apart from said photosensitive surface;
apparatus for supporting said corona assembly for adjustment of the separation between said corona assembly and said photosensitive surface comprising:
support means for slidingly supporting said corona assembly for movement substantially parallel to said photosensitive surface; and
camming means engaging said support means for moving said support means toward and away from said photosensitive surface;
wherein said support means comprises:
at least one rail adapted for slidingly engaging said corona assembly for said movement substantially parallel to said surface and for holding said corona assembly relative to said surface; and
two slidingly mounted, spaced apart end plates for supporting said at least one rail therebetween, each said end plate having an elongate slot adapted to engage closely said camming means for separate movement; wherein each of said end plates further comprises:
(1) a first and second hole; and
(2) a guide member adapted for slidingly engaging a positionally fixed guide track in said machine; and
a first and a second locking screw, said locking screws passing through said respective first and second holes, slidingly engaging two fixed tracks in the photocopying machine, and adapted for securing said end plate to said machine in a locked position;
whereby each of said end plates is constrained to move along a straight line substantially toward and away from said photosensitive surface.

4. In a photocopying machine comprising:
(1) a rotating drum having a photosensitive surface; and
(2) a corona assembly having at least one corona wire spaced apart from said photosensitive surface;
apparatus for supporting said corona assembly for adjustment of the separation between said corona assembly and said photosensitive surface comprising:
two slidingly mounted, spaced apart end plates oriented perpendicularly to a drum axial direction and supporting two rails therebetween, said rails adapted for slidingly engaging and holding said corona assembly;
a first and second rotatable cam member each eccentrically mounted to a respective positionally fixed portion of the machine;
wherein each of said end plates has:
(a) an elongate slot adapted to engage closely a said rotatable eccentric cam;
(b) a guide member adapted for slidingly engaging a positionally fixed guide track in said machine; and
(c) a first and a second hole; and
a first and second pair of locking screws, each said pair of locking screws passing through a said respective first and second holes, slidingly engaging two fixed tracks in the photocopying machine, and adapted for securing said respective end plate to said machine in a locked position;
whereby each of said end plates is constrained to move along a straight line substantially toward and away from said photosensitive surface as each said eccentric cam member is rotated.

* * * * *